US007481235B2

(12) United States Patent
Prusmack

(10) Patent No.: US 7,481,235 B2
(45) Date of Patent: Jan. 27, 2009

(54) ARTICULATING HUB ASSEMBLY

(75) Inventor: A. Jon Prusmack, Valley Cottage, NY (US)

(73) Assignee: DHS Systems LLC, Orangeburg, NY (US)

( * ) Notice: Subject to any disclaimer, the term of this patent is extended or adjusted under 35 U.S.C. 154(b) by 385 days.

(21) Appl. No.: 11/250,340

(22) Filed: Oct. 14, 2005

(65) Prior Publication Data

US 2007/0084493 A1 Apr. 19, 2007

(51) Int. Cl.
*E04H 15/36* (2006.01)
*E04B 7/10* (2006.01)

(52) U.S. Cl. ..... 135/135; 135/122; 135/131; 135/147; 135/120.3; 52/83; 52/81.3; 52/646; 403/172

(58) Field of Classification Search ..... 135/124, 135/130–131, 135, 143–146, 156, 115, 120.3, 135/120.4, 906, 909, 121–122, 151; 52/80.2, 52/81.1, 81.3, 83, 109, 646, 648.1, 656.9; 403/171–174, 217; 160/135; 40/610, 605
See application file for complete search history.

(56) References Cited

U.S. PATENT DOCUMENTS

| | | | | | |
|---|---|---|---|---|---|
| 3,941,140 | A * | 3/1976 | Beavers | 135/147 |
| 4,099,888 | A * | 7/1978 | Simone | 403/172 |
| 4,276,726 | A * | 7/1981 | Derus | 52/109 |
| 4,280,521 | A * | 7/1981 | Zeigler | 135/120.3 |
| 4,369,000 | A * | 1/1983 | Egnew | 403/13 |
| 4,437,275 | A * | 3/1984 | Zeigler | 52/109 |
| 4,512,097 | A * | 4/1985 | Zeigler | 40/610 |
| 4,580,375 | A * | 4/1986 | Nodskov et al. | 52/109 |
| 4,663,899 | A * | 5/1987 | Nodskov et al. | 52/109 |
| 4,941,499 | A * | 7/1990 | Pelsue et al. | 135/125 |
| 5,069,572 | A * | 12/1991 | Niksic | 403/170 |
| 5,797,695 | A * | 8/1998 | Prusmack | 403/170 |
| 6,378,265 | B1 * | 4/2002 | Konstandt | 52/655.2 |

* cited by examiner

*Primary Examiner*—Winnie Yip
(74) *Attorney, Agent, or Firm*—Thomas A. Beck

(57) ABSTRACT

A collapsible self-supporting structure used in combination with an improved articulating hub assembly. The articulating hub assembly is used as a connector among tubular rod elements which together provide a generally tubular frame matrix used to erect a collapsible self-supporting prefabricated deployable structure where a clear span interior without supporting columns is required.

28 Claims, 14 Drawing Sheets

ARTICULATING HUB ASSEMBLY

CROSS REFERENCE TO RELATED APPLICATION

This application is related to my application Ser. No. 11/2228,651, filed Sep. 15, 2005.

FIELD OF THE INVENTION

The present invention relates to collapsible, self supporting structures and an improved articulating hub assembly used as a connector among tubular rod elements. The hub assembly and tubular rod elements provide a generally tubular frame matrix used to erect a collapsible self-supporting prefabricated deployable structures where a clear span interior without supporting columns is required.

BACKGROUND OF THE INVENTION

Portable deployable building assemblies must have a foldable capability so that they may be erected where desired and, when necessary, folded up to a compact form for storage and/or transportation. These portable building assemblies utilize struts, which are tubular rods, as the basic construction unit, that form the skeleton structure and thus the configuration of the portable building assembly. The tubular rods noted above are interconnected with one another by some type of movable interconnecting fastening means such as a hub, so that the completed structure is articulated and collapsible. A plastic, canvas or some other type of durable fabric covering is usually applied to the outside and inner surface planes of the tubular rods to envelope the assembly and provide a covered shelter.

An example of such a collapsible structure is shown in U.S. Pat. No. 3,185,164, ('164) which discloses a portable structure having a plurality of rods joined by coupling means into groups of three which are inter-related to form a generally hexagonal structural system. The structure disclosed in '164 employs flexible stays or cables to form the extended shape of the structure and render the structure self-supporting. Another example of such a collapsible structure is shown in U.S. Pat. No. 3,710,806, which employs hub-connected multiply-hinged scissor-type linkages where the linkages articulate allowing the structure to expand or contract. Portable structures that utilize elements which maintain the rigidity of the structure are disclosed in U.S. Pat. No. 3,063,521. Like '164, the structures described in U.S. Pat. No. 3,063,521 employ tension elements such as wires or cables to render the structure self-supporting.

U.S. Pat. No. 3,968,808 ('808) discloses a collapsible self-supporting dome-like structure with a network of pivotal rods interconnected with linking joints. The linking joint holds six rods, each connected to a six-sided metal ring. Each rod is connected onto the ring and is capable of pivoting about the ring. The rod is a permanent attachment and thus cannot be disconnected nor replaced. There does not appear any way to attach a cover to the dome-like structure such as is found in the "keeper" component in the articulating hub assembly of the present invention. Further, the hexagonal ring design described by '808 has six facets, thus offers positions for up to six rods, and the rods must extend radially outward from the linking joint such that rods on opposite sides of the linking joint share a common geometric plane.

U.S. Pat. No. 4,026,313 also discloses a collapsible self-supporting dome-like structure with a network of pivotal rods interconnected with linking joints. The pivotal device linking the rods together forming the structure is a circular joint. Each joint has only four rods which extend radially outward from the joint such that rods on opposite sides of the joint share a common geometric plane. Each rod contains a plug ending with a small cylinder. This small cylinder is nested inside the joint and allows the rod to rotate. It appears that none of the components is easily interchanged. The top and bottom sections of the hubs in the reference appear to be permanently joined by an adhesive so that none of the rods or plugs can be replaced.

U.S. Pat. No. 4,512,097 discloses a display panel mounting clip. The clip body is used to connect display panels together. The clip assembly disclosed requires a spring mechanism to create tension and hold the panels together. The present invention requires no springs. The clip disclosed in the reference must be snapped into an opening joining the rods in a circular joint. In the present invention, the circular hub is screwed into the hub section so it is threadedly secured.

U.S. Pat. No. 4,280,521 discloses a hub assembly for collapsible structures. The hub assembly disclosed in the reference requires a circular retaining ring to hold the "column like elements" or tubes in place. Each tube must be threaded onto a circular retaining ring prior to insertion into the hub section. The tubes are arranged such that tubes on opposite sides of the hub rotate within the same plane. In the hub disclosed in U.S. Pat. No. 4,280,521, the hub sections are secured in place by use of an adhesive to fuse the two hub sections together permanently. The tube members within the structure, therefore, are not easily replaceable since the hub sections cannot be replaced without destroying them.

In the present invention no circular ring is present or required to hold the rods together inside the hub to allow rotation. The present invention as explained in detail hereinafter, requires that each tube have its own tang, each with its own roll pin to independently nest inside the hub body, thus no ring is present. It is an object of the present invention to provide a hub assembly that has the capability of quickly and easily removing the strut which is contained within the hub.

The U.S. Pat. No. 4,280,521 design, described above, uses a three piece clamping device to hold or attach a skin or cover to the structure. One piece is a plug that is incorporated inside the hub section and is fused into the hub sections. The second piece is a flat disc. The third piece is an element which is a screw. The screw is threaded into the plug and holds the clamp down. A screw driver would obviously be required to remove the clamp if or when the cover, the skin or the tubes have to be replaced.

Soviet Patent No. 1,392,220 discloses a joint between rods which possesses two pressure plates whose surfaces face each other and have spherical loons with slits from each loon to the outer outline of the pressure component plate. Screws appear to join the upper plate with the lower plate to hold the ball joints in place. The reference does not disclose a hub assembly such as described and claimed herein.

Collapsible frame structures for supporting tents or other outdoor shelters are disclosed in U.S. Pat. Nos. 563,376; 927,738; 1,773,847 and 2,781,766. These structures do not possess the improved hub of the present invention to allow the flexibility found in the structures using the hub of the present invention. Other collapsible structures disclosing some form of connecting means to hold the tubular rods in place are described in U.S. Pat. Nos. 3,968,808; 4,026,313; 4,290,244; 4,437,275; 4,473,986; 4,512,097; 4,522,008; 4,561,618; 4,579,066; 4,607,656 4,641,676, 4,689,932, 4,761,929, 4,779,635 and 4,838,003.

The typical prior art structures disclosed in the references cited above suffer from a common problems. With respect to the collapsible structure, due to the immense size which is needed in many present military and civilian applications, it is often difficult to erect (i.e., to raise or to lower) the skeleton structure. The inherent difficulties are that to erect or to collapse the structure requires several workers, takes a significant amount of time, and requires special tools and equipment. In addition, in the collapsed state, existing structures are too large. Thus the structures are bulky and heavy and have a complicated construction. The deployable portable building assemblies must be capable of being collapsed quickly an easily folded up into a compact structure.

The type of building assemblies using the hub disclosed in U.S. Pat. No. 5,797,695 ('695) to A. Jon Prusmack conveniently collapse to a bundle having a cylindrical configuration along its longitudinal axis when stored.

Cross sectional representation of the outline of the perimeter of an example of the structure disclosed in the '695 patent is depicted in FIG. 1A with five "sections" or "quads" using a specific and small diameter tubular rod. FIG. 1B represents the perimeter of the shelter of present invention and depicts seven "quads", I through VII using a much larger diameter tubular rod have side and diagonal elements formed from tubular strut elements connected at each end and in the center to a hub. Practical and structural considerations limit each of the five sections found in the '695 prior art structure to 5 feet square. Thus the structure in the embodiment depicted in FIG. 1A has a maximum horizontal distance between quad 1 and quad 5 of 11.75 feet. The limitations stem from the design of the hub where the rods on opposite sides of the hub share the same geometric plane, thereby limiting the diameter of the rods to 0.5 inches if acceptably compact collapsed structures are to result. The limitations on the size of the structure result from structural properties of practical 0.5 inch diameter rod and structural requirements of erected structures.

In order to function efficiently, the dimensions of each of the rectangular sections comprising the structure must be suitable to allow the structure to be erected speedily as well as allowing the structure to be collapsed speedily.

As noted above, each of the quads of the commercially efficient deployable structure, as contemplated in the '695 patent as depicted in FIG. 1A, possesses tubular strut elements that together with the hubs measure about 5 feet in length and width. The diameter of the prior art tubular strut elements contemplated by the '695 patent is about ⅝" (0.625"). These length/diameter dimensions allow the tubular rods of the structure to be collapsed into the cylindrical configuration noted above. Using the 5 feet quad dimensions and the tubular strut of ⅝" diameter, when the structure is erected, the distance from the ground to the center point of quad 3 of FIG. 8.25 feet.

When attempting to construct a portable building assembly having greater height, width and length dimensions compared with the '695 assembly, it was determined that serious problems were encountered with the structural integrity of the shelter.

In the situation in which one is forming a larger deployable structure than that enabled by the '695 patent, a larger, stronger tubular strut would be required than the existing struts having a diameter of ⅝". The larger diameter strut using the same size hub as disclosed in the '695 Patent will not produce a shelter possessing the required features necessary for prompt tactical deployments. An increased diameter strut (i.e., greater than ⅝"), used in combination with the prior art hub, will not collapse to an adequately compact bundle when collapsing the structure. Accordingly, the structure cannot be folded to possess the required volume in the collapsed state or "low racking volume."

If one desires to construct a larger shelter unit as depicted in FIG. 1B, having a height, for example, of 18 feet up to 32 feet, and accordingly a wider horizontal space between the sides I and VII , the additional stress on the tubular struts in the expanded structure of the assembly as well as other factors must be considered. The increased building dimensions does result in increased weight. If one opts to increase the diameter of the tubular struts comprising the quads in the construction of a larger deployable shelter to compensate for the increase in stress resulting from the wider span and added weight, substantial construction problems result. If the tubular strut is increased to, for example, 7 feet, the complementary angles between sections I and II, II and III and III and IV, etc. will be changed, so the symmetry which is inherent in the '695 prior art shelter is lost and the structure is totally different and unsuitable for the required prompt set-up and fold-up.

In my copending application, Ser. No. 11/228,651 certain basic features of articulating hub assemblies are also disclosed. As noted, that application is incorporated by reference herein.

BRIEF SUMMARY OF THE INVENTION

The present invention relates to a portable, deployable building assembly comprised of struts interconnected by hubs. Another feature of the present invention is an improved hub which links the tubular rods together in forming the building structure.

The unique articulating hub assembly of the present invention is an integration of eight separate components (quads) that when connected form a novel means for pivotally joining a network of tubular interconnecting rods forming the matrix for a collapsible structure. Multiple assemblies are used as pivotal devices for the movement of tubes to allow the quick erection and striking of a tubular frame supported structure.

A first significant feature of the present invention is to allow the tubes to articulate or move freely when either upward, (i.e., vertical) or opposing side,( i.e., horizontal) forces are applied. These forces cause a 180° (i.e., a semi-circular) rotation of the tube components which comprise up to eight tubes per hub.

More specifically, with respect to the collapsed network of tubular struts, assemblies, etc. laid out prior to erection, when manual upward pressure is applied at 90° (i.e., perpendicular) to the ground at specific location on the network, multiple hub assemblies are displaced from positions physically contacting the ground to specific elevated positions above the ground. The upward vertical force creates an action that moves the articulating hub assemblies of the present invention from static positions to tension positions and forms a structure of interconnected tubes and articulating hub assemblies that is self-supporting. The resultant structure has four physical sides. The size and the shape of the structure can vary based upon the length of the tubes and the location of scissor points.

To collapse the frame to its original position on the ground, simultaneous and opposing forces are applied on each of the four sides of the structure, 180° to each other and 90° to the vertical (along the 0° or X-axis), to specific articulating hub assemblies.

This action allows the tubular strut to move from a tension position with the assemblies above ground, back to a static position and collapse down to the original location on the ground.

The appropriate diameter of the hub of the present invention is a function of the size of the deployable structure to be assembled. The hubs are of different size depending upon the dimension of the shelter in which they are used. The hub of the present invention has an octagonal shape which allows larger diameter tubular struts of ¾ (0.75) inch or greater which are fixed in the slits in the hub to rotate when erecting or collapsing the structure.

Further, the slits which secure the tubular struts into the hub are offset at a 45° angle so that the struts emanating radially from any given hub rotate within a unique geometric plane not shared with any other rod, thus the rods can easily fold in on themselves and provide a compact bundle for storage or expand easily for a quick set-up.

There are two embodiments of the hub of the present invention. For the purposes of this disclosure, they are designated the "J" and the "M" hubs. The hubs have substantially identical configuration with the "J" hub having a larger overall dimension. Where not specifically mentioned herein, the drawings serve to cover both embodiments. To facilitate assembly of the hub, the bottom half of the assembly is substantially thicker than the top, and contains slits to capture the tang and pin elements of the rods.

A cross sectional view of the configuration of the struts and hubs shelter of the present invention is depicted in FIG. 1B. The quads formed using the "J" hub are maximally 7 feet square with a height when the structure is erected between the ground to the center point of quad IV of up to 12.5 feet. The quads formed using the "M" hub are maximally 4'10" feet square, with a height when the structure is erected between the ground to the center point of quad IV of up to 8.75 feet. The addition of two quads to that disclosed in the prior art '695 patent shelter allows larger shelters to be constructed. The horizontal distance between quad I and quad VII in FIG. 1B will vary depending upon which hub is used.

A second significant feature of the articulating hub assembly of the present invention is the ability to secure fabric covers (covering the tubular frame network) to the hub body and allow the two covers (interior and exterior) to move simultaneously with the tubular frame. In the assembly there is a mushroom shaped keeper element, having a top and a shaft extended downwardly therefrom, wherein the shaft is capable of being inserted through the hub top, and the shaft is capable of being secured to the hub bottom. The central opening of the hub bottom may be threaded, and the shaft of the shaft of the keeper element also threaded to coincide with the central threaded opening of the hub bottom to allow the keeper to threadedly engage the hub body. Where a cover is placed over the tubular structure, the keeper element may secure the cover by holding the cover between the top of the keeper element and the hub top in a configuration where the shaft of the keeper element is placed through an opening in the cover and secured to the hub body. The top of the keeper is contoured to match the slope of the exposed surface of the hub cover.

Objects and features as well as additional details of the present invention will become apparent from the following detailed description and annexed drawings of the presently preferred embodiments thereof, when considered in conjunction with the associated drawings.

The collapsible structure of the present invention is a substantial improvement over prior art reference assemblies. The present invention enables the rapid deployment of larger structures from a given collapsed volume, relative to the prior art, and enables collapsible structures with absolute dimensions larger than previously possible. In particular the hub assembly of the present invention is a substantial improvement over prior art in that it enables rods of the deployable structure to form a more compact collapsed form and enables the use of larger diameter rods where required for larger or more robust structures.

DETAILED DESCRIPTION OF THE INVENTION

As noted above, the present invention relates to a deployable shelter and an articulating hub assembly which serves to connect tubular rods that comprise the basic construction elements for a prefabricated, self-supporting, deployable structure.

Figure 1A:
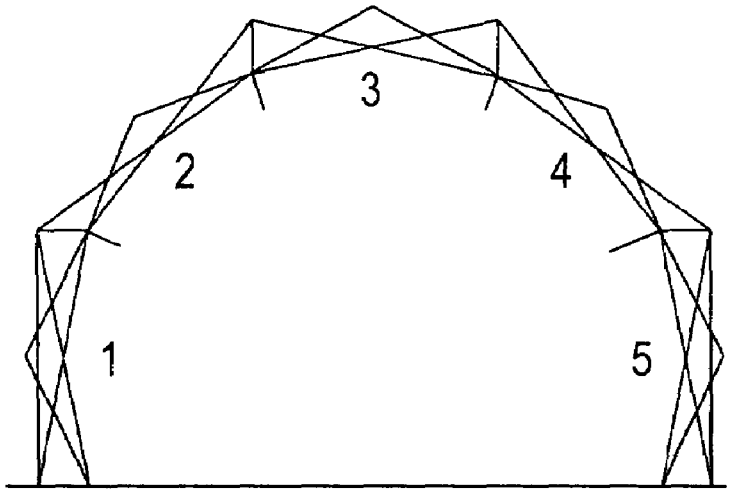
prior art FIG. 1A
FIG. 1A is a front view cross-sectional representation of the perimeter outline of a deployable structure as found in the prior art.
Figure 1B:
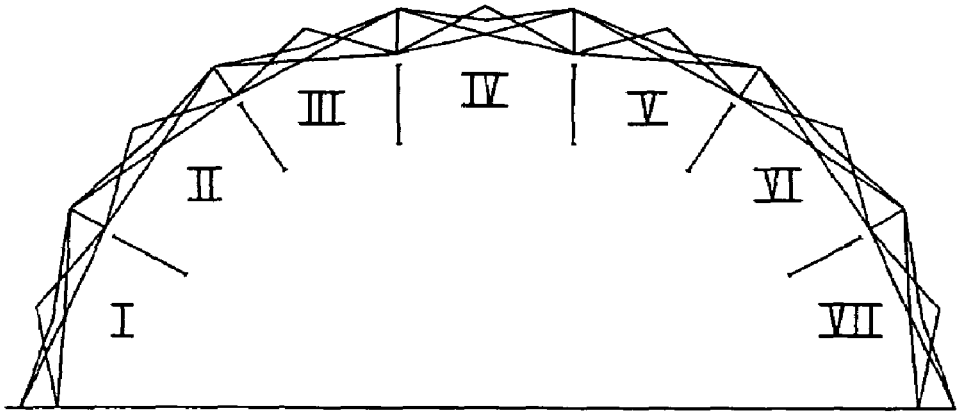
FIG. 1B is a front view cross-sectional representation of the perimeter outline of the deployable structure of the present invention using the "J" hub.
Figure 1C:
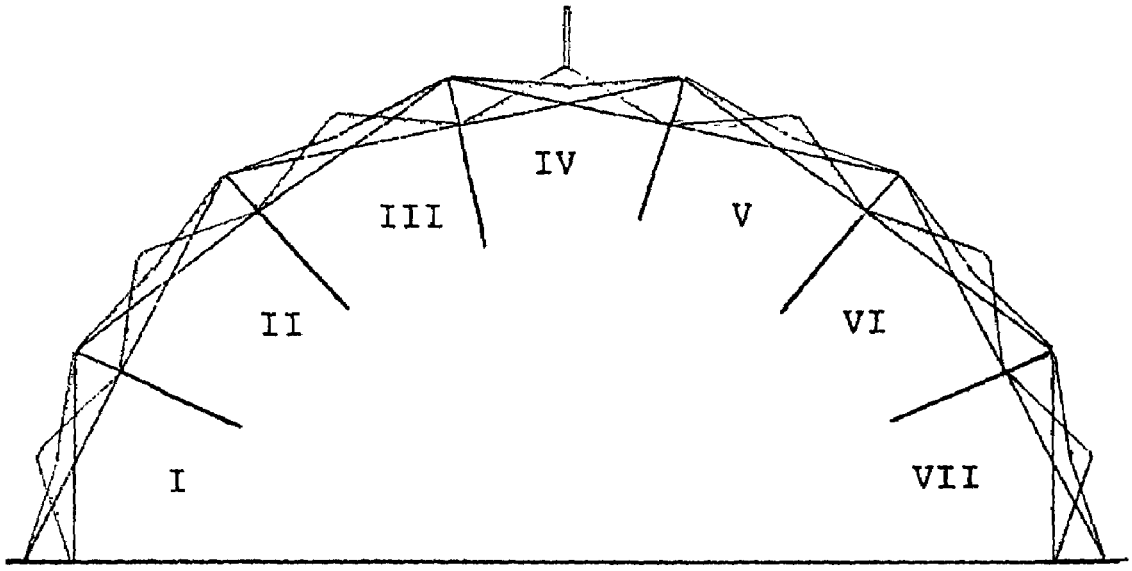
FIG. 1C is a front view cross-sectional representation of the perimeter outline of the deployable structure of the present invention using the "M" hub.
Figure 2:
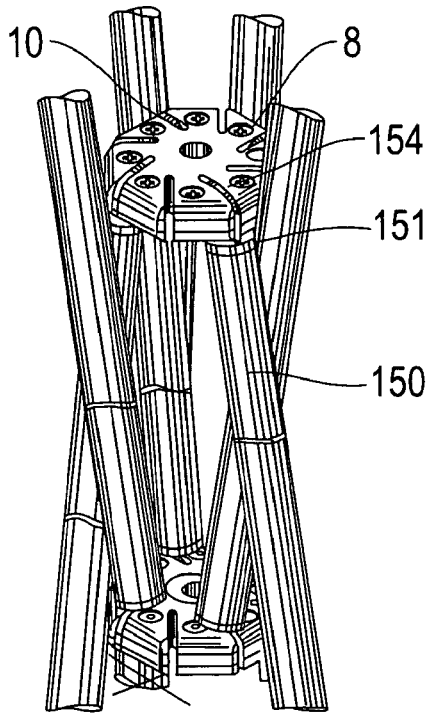
FIG. 2 is an oblique view of hubs and tubular struts as they appear when the deployable shelter is in a folded state.

Tubular struts 150 and two hubs 8 and 9 of the present invention, with the tubular struts in their intermeshed orientations when the structure is in a folded state, are shown in FIG. 2. When viewing the hubs as depicted in FIG. 2, the "bottom" element, 10, of hub assembly 8, is shown connected to four tubular struts, and the "top" element, 11, of hub assembly 9 is shown also connected to four tubular struts. The tubular struts are connected to the hub by means of a plug 151 affixed within the interior of tubular strut 150. Plug 151 is connected to tang 154 which is held within the hub body 8. FIG. 2 shows only 7 struts for clarity.

Figure 3:
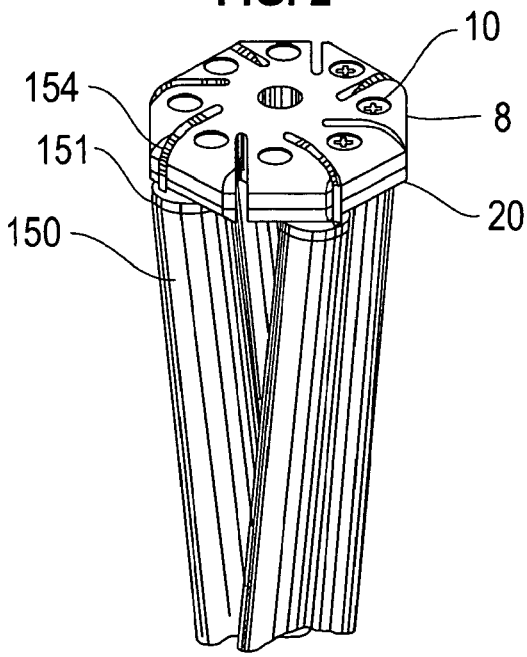
FIG. 3 is a magnified view of a portion of the structure depicted in FIG. 2.

FIG. 3 shows the "bottom" 10 of hub assembly 8 of the present invention, with four tubular struts 150 in their folded and intermeshed positions. Similar to FIG. 2, the tubular struts 150 are fastened to plug 151 which is in turn fastened to tang 154 which is captured within hub body 8 as is described in further detail below.

Figure 4:
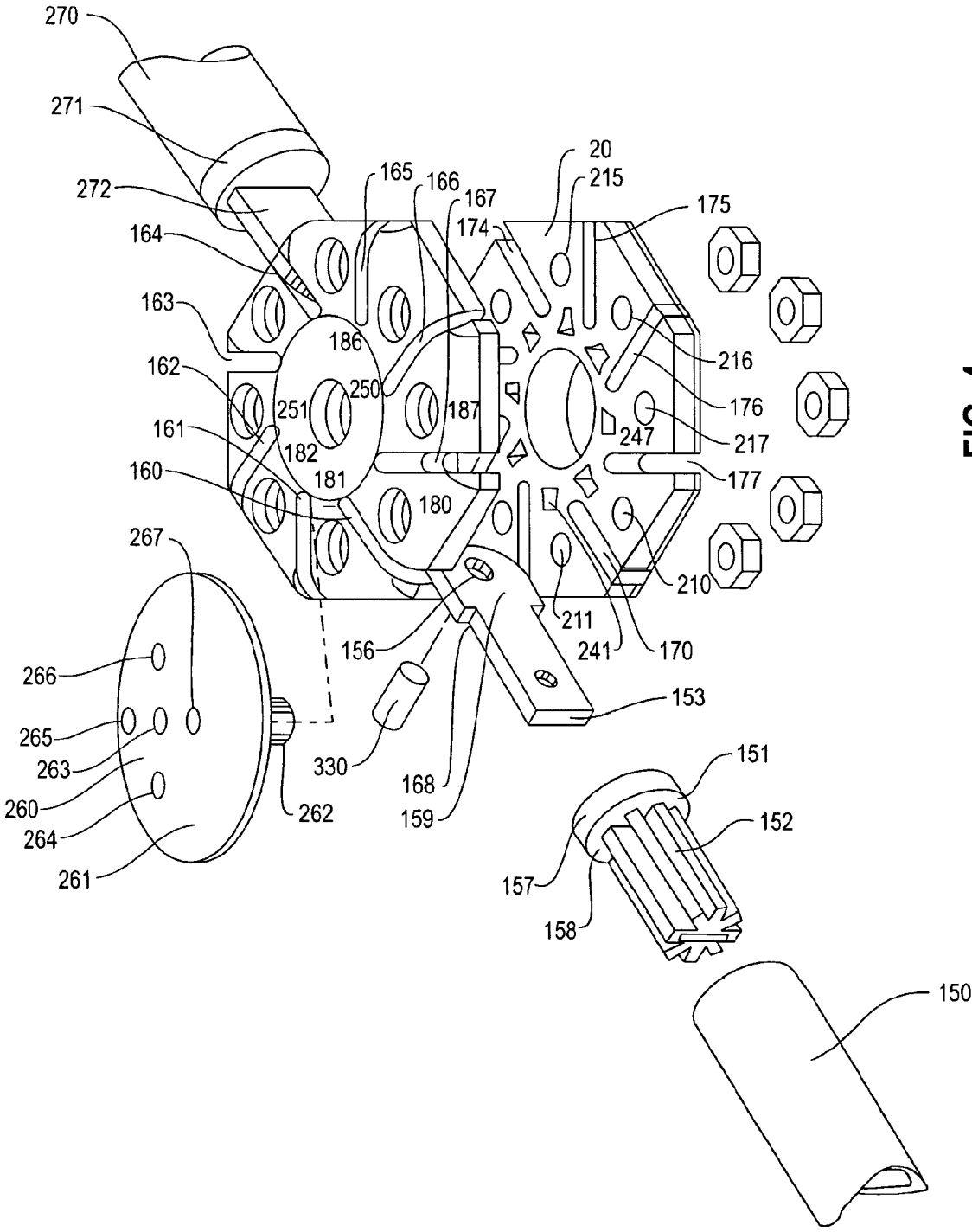
FIG. 4 is an exploded oblique view of the improved hub of the present invention.

FIG. 4 is an orthogonal exploded view of the articulating hub assembly of the present invention depicting the bottom 10 and top 20 sections of the hub body with the connecting end of tubular struts 150 and 270 of the skeletal matrix as well as other relevant parts shown in their respective locations when the assembly is in use. As illustrated in FIG. 4, within the end of tubular strut 150 is fastened plug 151 with the assistance of ribs 152. Plug 151 is generally and preferably cylindrical in shape and has a crown 157 at one end which rests against shoulder 158 when assembled. The diameter of the portion of plug 151 beyond crown 158 is substantially the same as the inside diameter of the tubular strut elements which form the skeletal matrix of the shelter. When assembled, a rivet (not shown) secures tang tail 153 in plug 151 to the tubular element (not shown). Head 159 of tang 154 is wider than tail 153 and merges therewith at shoulder 168. Tang 154 is captured within the hub assembly by means of roll pin 330 which is inserted through opening 156 in tang 154. Roll pin 330 is captured within groove 200 (shown in FIG. 6B) in hub bottom 10 so that tang 154 is captured by hub 8 but able to move within slits 160 and 170 in hub bottom 10 and top 20, respectively. Slits 160 and 170 are in registered alignment.

Into radial slits 160 and 170 there is inserted a tang 154 having a head 159 and a tail 153. Tang 154 is inserted through a plug 151 which is also inserted within the end of tubular strut 150. Tang 154 is held in place within hub bottom 10 by roll pin 330 which is inserted through an opening 156 through head 159. Roll pin 330 is secured in a groove (not shown in FIG. 4 but shown in FIG. 6B) in the underside of hub bottom 10. (See FIG. 6B.)

The tail 153 of tang 154 is sufficiently long to extend radially outward from radial slits 160 and 170. Tail 153 of tang 154 possesses a width substantially the same as is present in a slit that extends radially through plug 151.

Hub bottom 10 has seven slits analogous to slit 160 (161 through 167), and hub top 20 has seven slits analogous to slit 170 (171 through 177), in registered alignment with the slits in the hub bottom.

Within hub bottom 10 are openings 180 through 187. These openings are recessed and are in registered alignment with openings 210 to 217 in hub top 20. Each opening 180 through 187 and 210 to 217 receives a means for securing bottom 10 and hub top 20. Preferably the securing means is a fastener 280 through 287, not shown in this view. Openings 180 through 187 in the hub bottom 10, and 210 to 217 on the top 20 are preferably recessed so the heads of the fasteners and the nuts (not shown) lie flush with the respective surfaces of the hub. The nuts and fasteners referred to are tightened to secure hub top 20 to hub bottom 10.

The openings in hub top 20 also are provided with recesses 220 to 227. Recesses 220 to 227 are configured to both capture nuts 230 to 237 and enable them lie flush with the respective surfaces of hub top 20. The fasteners and nuts 230 to 237 are threaded so that they may be threadedly engaged.

To improved structural performance and minimize weight, hub top 20 contains wells 240 to 247.

Hub bottom 10 has a central opening 250 with threads 251 whereas hub top 20 has a larger central opening 252.

Hub assembly 8 may be equipped with one or more keepers, 260. The keeper is mushroom shaped, with a top 261 and a shaft 262. The top 261 and has one central well 263 about which are distributed four wells 264 to 267. The shaft 262 of the keeper is threaded to match that of central opening 250 so that it may engage threads 251 of hub bottom 10. In addition to the nuts and fasteners noted above, keeper component 260 also secures hub bottom component 10 to hub top component 20.

Hub assembly 8 may connect anywhere from one to eight tubular struts. Shown in FIG. 4 are two tubular struts, 150 and 270. Analogous to tubular strut 150, plug 271 is fastened within tubular strut 270. Tang 272 is inserted in to plug 271. Tang 272 and plug 271 are fastened to strut 270 by means of a rivet, not shown. Tang 272 is also captured within hub assembly 8 by means of a roll pin which lies within a groove that is perpendicular to slit 164.

This view does not show the fabric which covers the tubular structure of the shelter. The cover can be any suitable fabric such as canvas, nylon, polyester, etc. and can be impregnated with fire retardants, insect repellent compositions, etc.

Figure 5A:
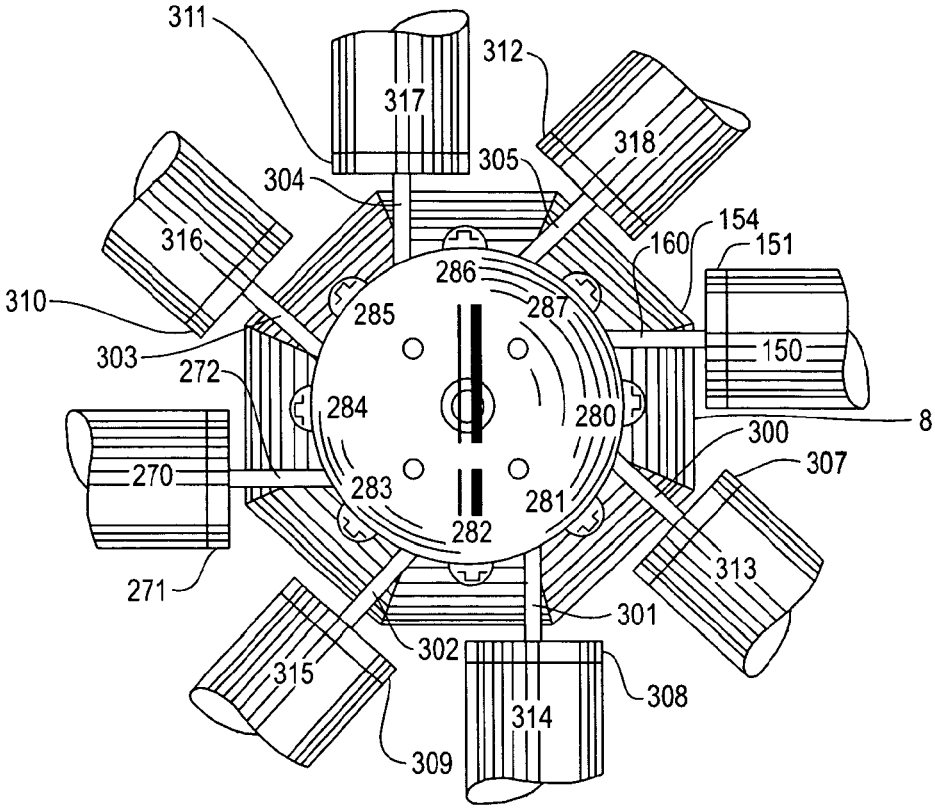
FIG. 5A is a plan view of the top of the improved hub of the present invention with the tubular struts and keeper in place.

FIG. 5A is a plan view of the top surface of the assembly depicted in FIG. 4 showing some of the elements detailed in FIG. 4, including the octagonal shape of hub top 20 of hub assembly 8. FIG. 5A includes hub assembly 8 with eight tubular struts each with a plug, as illustrated by element 151, and tang 154, each tang inserted within a slit as illustrated by element 160. Thus each strut is connected to hub 8 by means of tangs 154, 272 and 300 to 305 which in turn engage plugs 151, 271 and 307 to 312. The view shows eight fasteners as illustrated by elements 280 to 287 which are used to secure, in combination with eight fasteners (not shown) the superior element to the inferior element comprising the hub. Keeper 260 is fixed to the hub using any suitable means, and a loop 290, to hold wind lines, is secured to central well 263 of keeper 260 by any suitable means. The loop is generally permanently attached to keeper component 260.

Figure 5B:
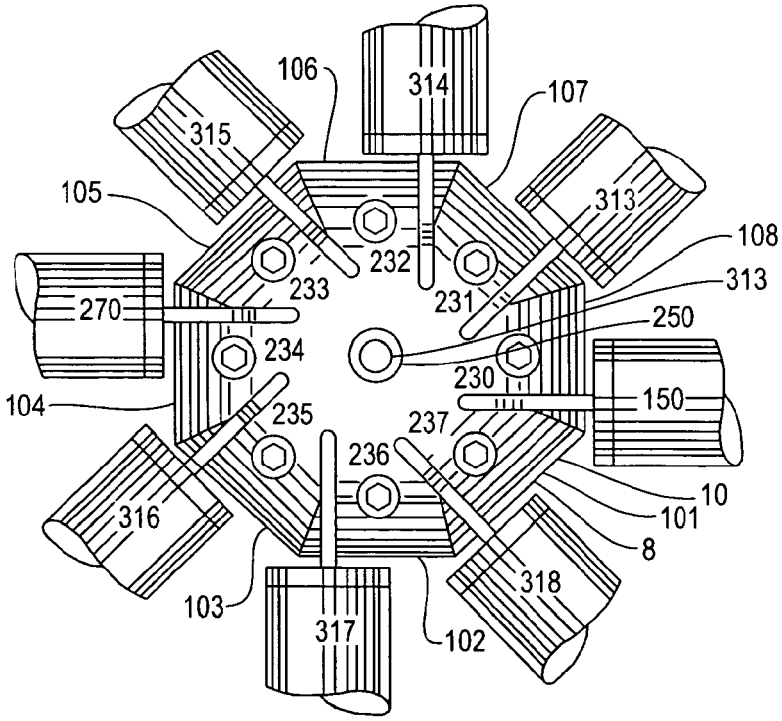
FIG. 5B is a plan view of the bottom of the improved hub of the present invention with the tubular struts and keeper in place.

FIG. 5B is a plan view of the bottom surface of the assembly depicted in FIG. 4 showing some of the elements detailed in FIG. 4 including the octagonal shaped hub bottom 10 of hub assembly 8 as it is used in combination with tubular struts the comprise the matrix of the deployable structure in the erected state. FIG. 5B includes hub assembly 8 with eight tubular struts 150, 270, 313 to 318 each within a slit as illustrated by elements 160 to 167. Struts 150, 270 and 313 to 318, are engaged to the hub by means of tangs 154 and 300 to 305 which are in turn engaged with plugs 152, 271 and 307 to 312. Hub bottom 10 has a central, threaded opening 250, within which is threadedly engaged the shaft 262 of the keeper 260. Hub bottom 10 has nuts, 230 to 237, which threadedly engage fasteners 280 to 287 (the tip of which are shown protruding through the center of nuts 230 to 237) to secure hub bottom 10 to hub top 20. The protruding tip 313 of hub keeper 260 appears in the opening in the center of the hub.

Referring to FIG. 4 and where necessary, FIG. 5A and FIG. 5B, hub 8 comprising the present invention therefore is an octagonal unit made up of two separable sections, hub bottom 10 and a hub top 20 (See also FIG. 5A and FIG. 5B). FIG. 4 specifically depicts the superior side of hub bottom 10 and the inferior side of hub top 20.

Accordingly, hub 8 contains 8 peripheral edges 101 to 108 which are continuously connected, each to the next, around its periphery thus forming 8 vertices each subtending an angle of 45°. Thus for each vertices, as for example between edge 101 and 102, the angle is 45°.

Immediately past the intersection of each of edges 101 through 108 around the periphery of the unit, slits 160 through 167 and 170 to 177 are cut normal to the peripheral edge in question into hub 8 in direct alignment through hub bottom 10 and hub top 20 that comprise hub 8. Each of the aforementioned 8 vertices formed by the intersecting edges 101 through 108 around the periphery subtends an angle of 45°. Accordingly, proceeding in a clockwise manner around the octagonal periphery of the hub with its defined sections, the adjacent slits cut into the hub each form an angle of 45° with the succeeding and preceding edges.

Figure 6A:
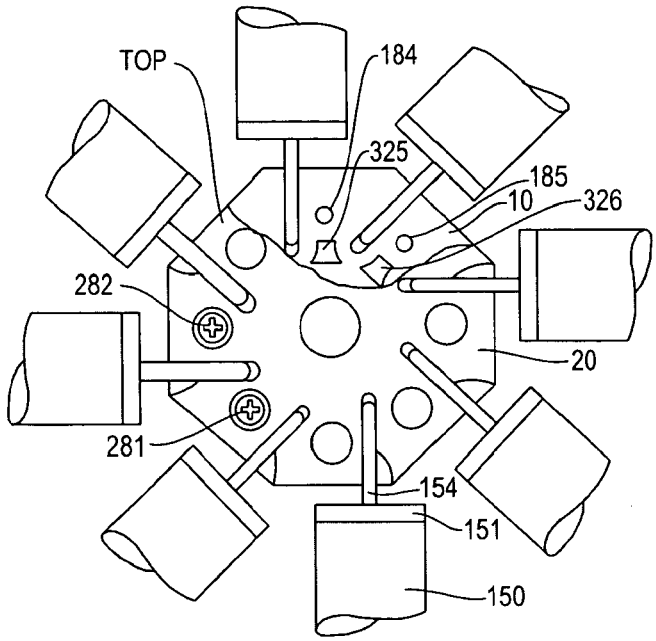
FIG. 6A is a plan view of the bottom of the improved hub with partial cutaway exposing the interior surface of the top of the improved hub of the present invention.

FIG. 6A depicts a plan view of hub assembly 8 showing, in a partial cut-away view, hub top 20 and hub bottom 10. Shown are the struts, 150, 270 and 313 to 318, each connected by way of a plug, 151, 271, 307 to 312, respectively, to a tang, 154, 272, 300 to 305, respectively, which is captured within the hub top 20 by means of a roll pin captured within a groove (not shown). The hub top 20 is secured to hub bottom 10 by means of a fastener, two of which are shown in this representation, 281 and 282. The cut-away portion of the drawing shows two of the eight wells 326 and 327 in hub bottom 10 as well as two of the eight openings 184 and 185 in hub bottom 10.

Figure 6B:
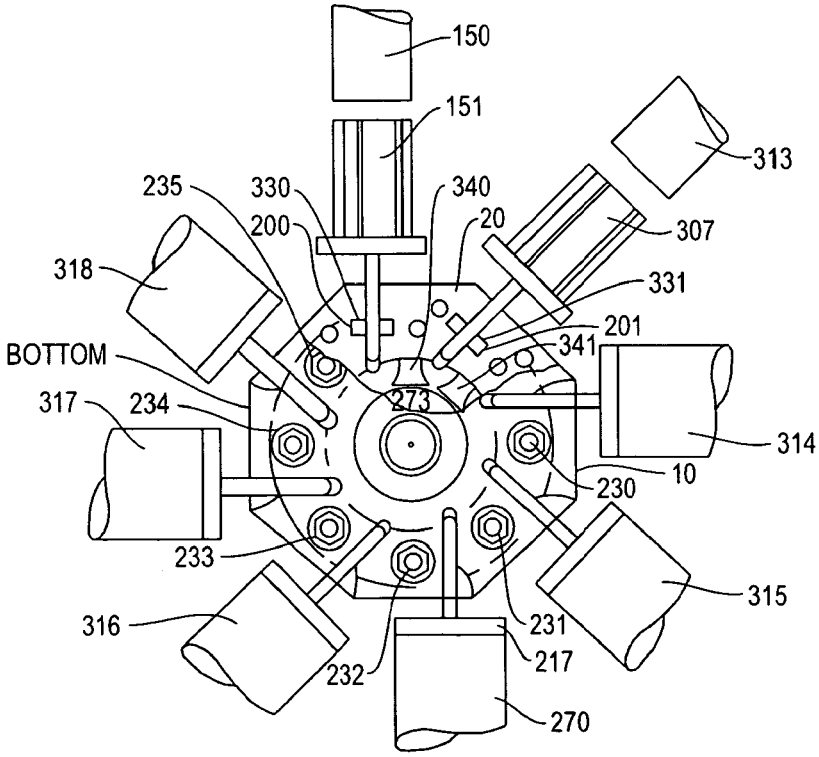
FIG. 6B is a plan view of the top of the improved hub with partial cutaway exposing the interior surface of the bottom of the improved hub of the present invention.

FIG. 6B depicts a plan view of hub assembly 8 showing, in a partial cut-away view, hub bottom 10 and hub top 20. Shown are struts 150, 270 and 313 to 318, each connected by way of a plug, 151, 271, 307 to 312, respectively, to a tang, 154, 272, 300 to 305, respectively, which is captured within the hub top 20 by means of a roll pin, two of which, 330 and 331, are shown. The roll pins, 330 and 331 are shown, are captured within hub top 20 by means of a groove, grooves 200 and 201 are shown. The hub top 20 is secured to hub bottom 10 by means of fasteners each of which is threadedly secured by a nut. In this view six nuts, 230 to 235, are shown. The cut-away portion of the drawing shows two of the eight wells 340 and 341 in hub top 20 as well as two of the eight openings 210 and 211 in hub top 20.

Figure 7A:
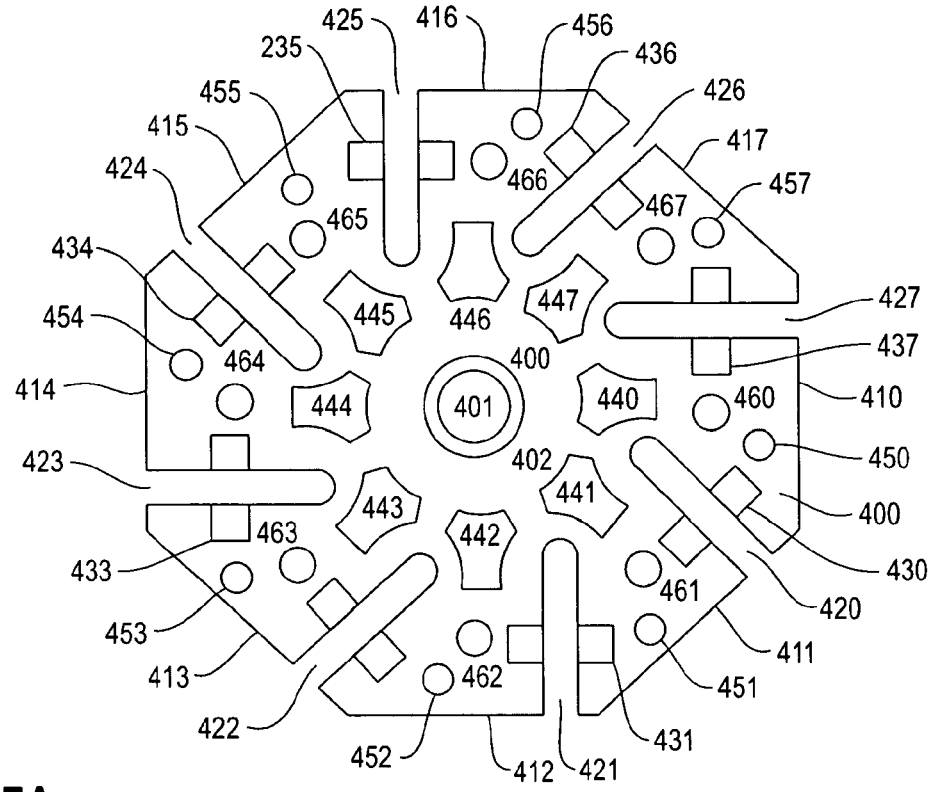
FIG. 7A is a plan view of the interior surface of the bottom half of the improved "J" hub of the present invention.

FIG. 7A depicts a plan view of a hub bottom of a second example of the invention. Depicted in FIG. 7A is the hub bottom 400 which has eight edges, 410 to 417 and eight slits, 420 to 427. Perpendicular to each slit is a groove, 430 to 437, for the purpose of capturing the roll pins (not shown) of the tangs (not shown). The hub bottom has eight interior wells, 440 to 447, and eight exterior wells, 450 to 457, to facilitate manufacture and improve the structural properties of the component. Hub bottom 400 has a central opening 401 which is threaded on its interior surface. The central opening is within a boss 402. Hub bottom is also provided with eight openings, 460 to 467, for fasteners (not shown).

Figure 7B:
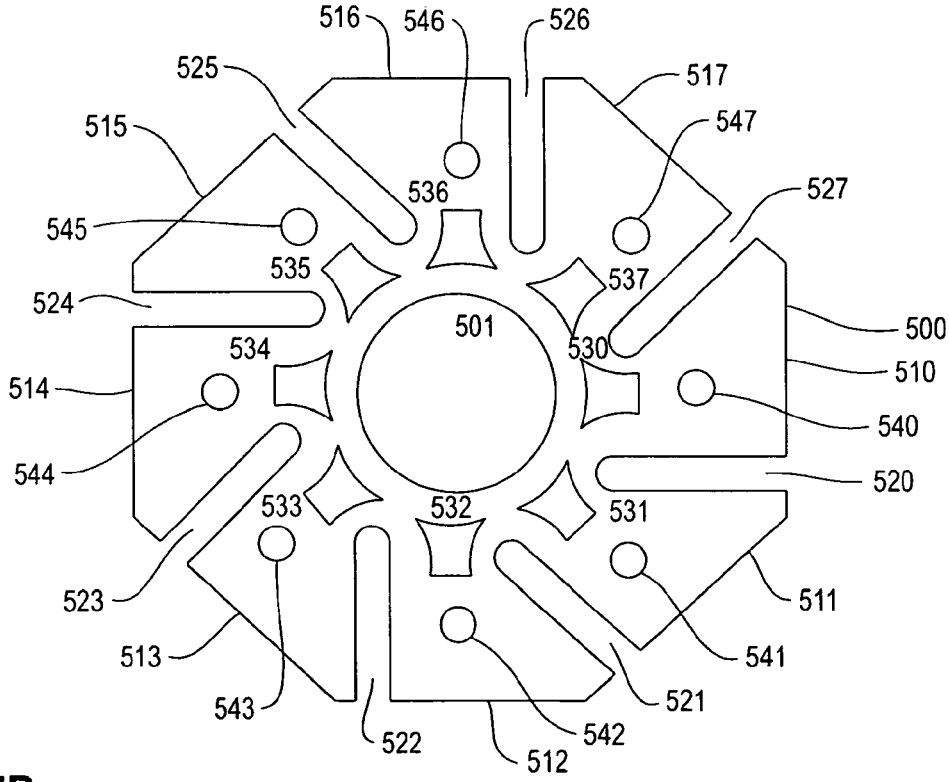
FIG. 7B is a plan view of the interior surface of the top half of the improved hub of the present invention.

FIG. 7B depicts a plan view of a hub top of a second example of the invention. Depicted in FIG. 7B is hub top 500 which has eight edges, 510 to 517, and eight slits, 520 to 527. The hub top has eight wells, 530 to 537, to improve the manufacturability and structural performance of the component, and eight openings, 540 to 547, for fasteners (not shown). The hub top 500 has a central opening, 501 with an interior dimension sized to accept boss 502.

To explicate the spatial relationships of the hub edges and the slits cut therein, reference is made to FIG. 6A, which describes example 1 of the present invention. FIG. 7A, which describes Example 2 of the present invention has analogous relationships. Referring to FIG. 6A, slits 160 and 170 are aligned and positioned normal to edge 106; likewise slits 161 and 171 are positioned normal to edge 107; likewise slits 161 and 172 are positioned normal to edge 108, and so it continues around the periphery of the octagonal hub. However each pair of slits (e.g., 160/170, 161/171 and 162/172) which are normal to their particular edge (106, 107 and 108 respectively) form an angle with the preceding and succeeding slits. Thus, the slits in the hub are all positioned at angle of 45° with respect to one another.

Each segment of hub 8 defines an area formed between each of slits 160 through 167 and 170 to 177 which is an incomplete right triangle. FIG. 6A shows that if a line following each adjacent slit were drawn from the edges of the hub and extended until they intersected, eight right triangles would result. In practice, the actual slits 160 through 167 and 170 to 177 cannot be so extended as the integrity of hub 8 would be destroyed.

Figure 8A:
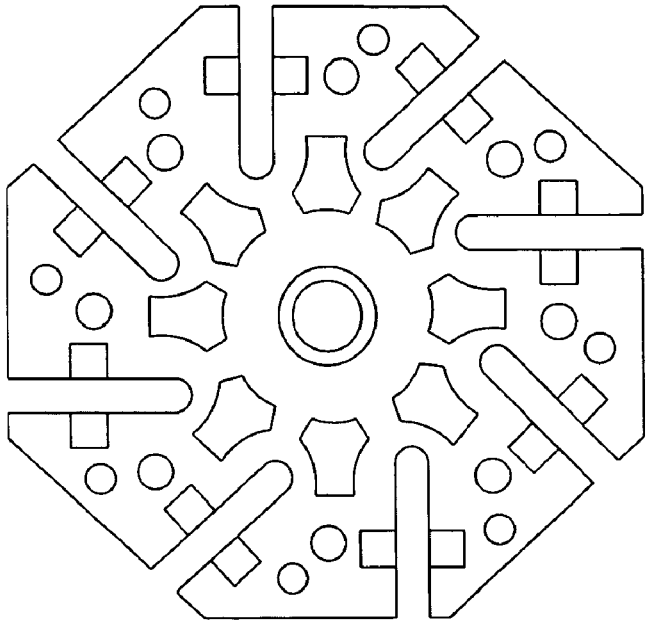
FIG. 8A is a plan view of the interior surface of the bottom half of the improved "M" hub of the present invention.
Figure 8B:
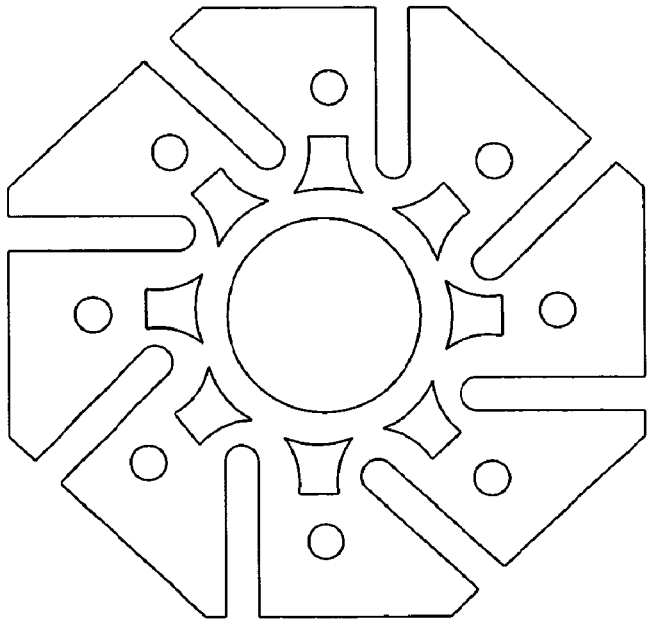
FIG. 8B is a plan view of the interior surface of the top half of the improved hub of the present invention.

FIG. 8 depicts plan views (not drawn to scale) of the interior surface of the bottom half of the improved "M" hub of the present invention and the interior surface of the top half of the improved "M" hub of the present invention.

Figure 9A:
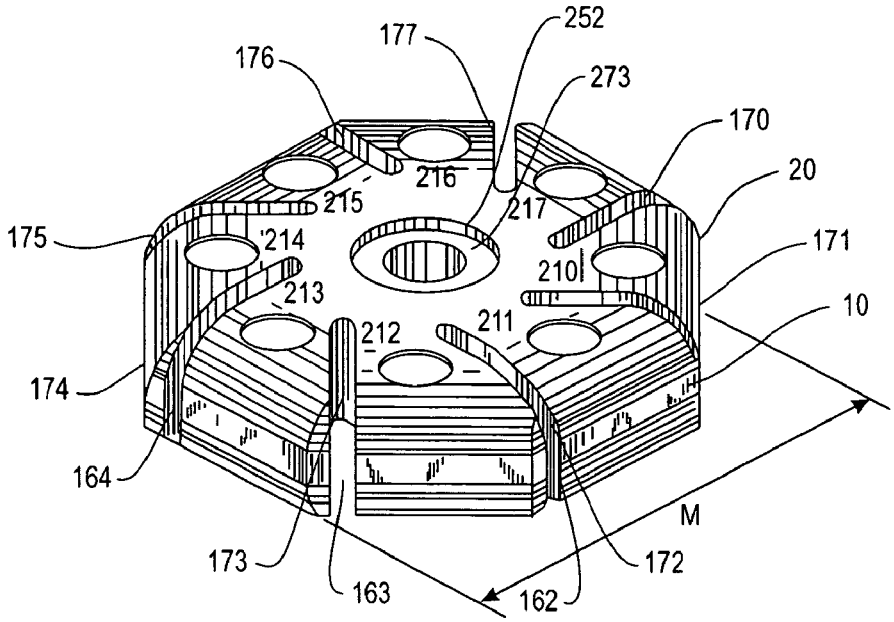
FIG. 9 (A and B) is an oblique view of the top section of the "M" hub and the "J" hub showing the relative difference in size (not drawn to scale).
Figure 9B:
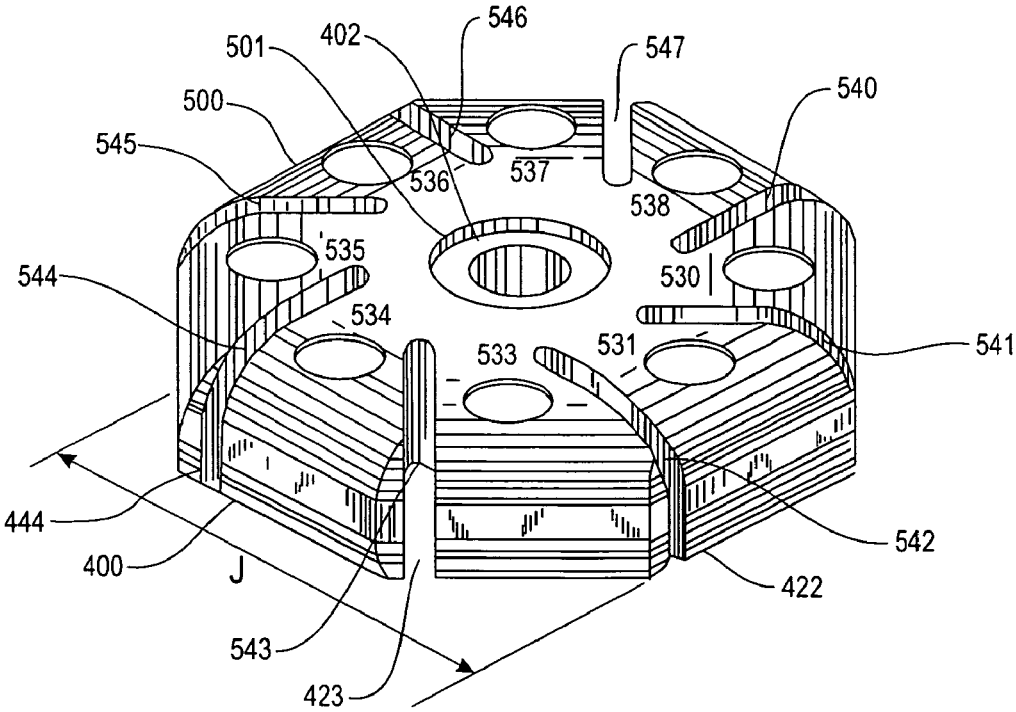

FIG. 9 depicts oblique views of the invention, Example 1 in FIG. 9A and Example 2 in FIG. 9B. FIG. 9A shows the hub top 20 and hub bottom 10 in their assembled orientation. The boss 273 of hub bottom 10 is shown within the central opening 252 of hub top 20. The slits of the hub top 170 to 177, are in registered alignment with those of the hub bottom, 160 to 167. Shown are openings 210 to 217 for fasteners (not shown). FIG. 9B shows hub top 500 and hub bottom 400 in their assembled orientation. Within hub top 500 is central opening 501. Within central opening 501 is boss 402 of hub bottom 400. As in Example 1, the slits of the hub top 540 to 547, and the slits of the hub bottom 420 to 427, are in registered alignment. Shown within hub top 500 are openings 530 to 537 for fasteners (not shown).

Figure 10A:
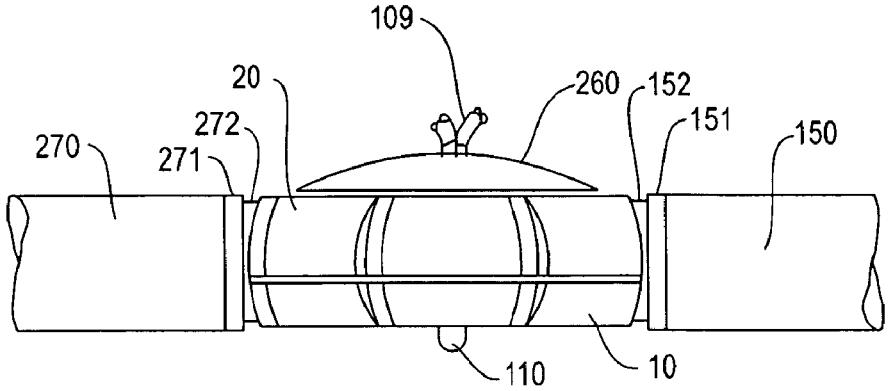
FIG. 10A is a side view of the improved "J" hub of the present invention.

FIG. 10A depicts a side view of the hub assembly 8, comprised of top 20 and bottom 10, showing only two sets of struts 150 and 270, plugs 151 and 271 and tangs 154 and 272, for clarity. Also shown is loop 109 captured within keeper 260 by knot 110. Keeper 260 is shown in its assembled position threadedly secured to hub bottom 10.

Figure 10B:
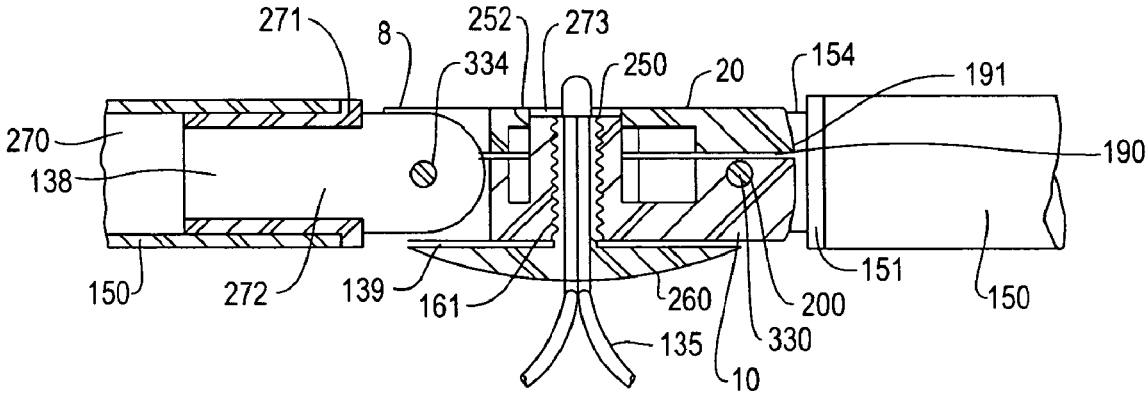
FIG. 10B is a cutaway cross sectional view of the improved "J" hub of the present invention.
Figure 11A:
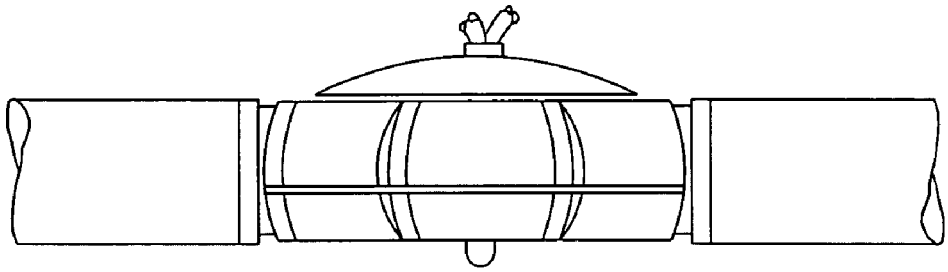
FIG. 11A is a side view of the improved "M" hub of the present invention.
Figure 11B:
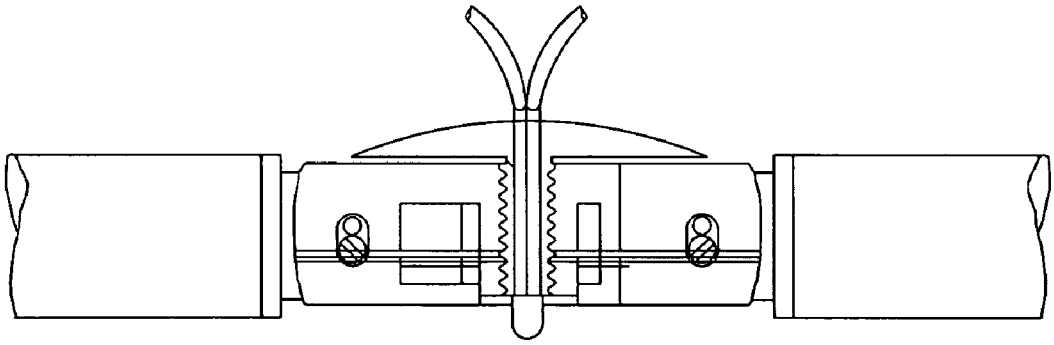
FIG. 11B is a cutaway cross sectional view of the improved "M" hub of the present invention.

FIG. 10B depicts a side view taken along the line 10-10 of FIG. 5A the octagonal embodiment showing hub assembly 8, comprised of hub top 20 and hub bottom 10. Threadedly secured in hub bottom 10 is keeper 260. For clarity, only two plugs 151 and 271, captured within two struts 150 and 270 to which are secured two tangs 154 and 272 are shown. The tangs are secured to the hub assembly by means of roll pins 330 and 334 which reside in grooves. For clarity only groove 200 is shown. Hub bottom 10 is thicker from its underside to the top surface thereof than the thickness of hub top 20. As depicted also in FIG. 6A and FIG. 6B, at the center of hub bottom 10 there is a boss 273 with a threaded opening 250 extending upwardly from the upper surface of hub bottom 10. Hub top 20 has an opening 252 in the center extending through its thickness which opening has a diameter sufficient to accommodate boss 273. Boss 273 of hub bottom 10 is centered in alignment with opening 252 of hub top 20 and is of sufficient depth so that its terminal portion is flush with the upper surface of hub bottom 10 when the upper flat surface 190 of hub bottom 10 is continuously throughout in contact with the lower flat surface 191 of hub top 20. Keeper component 260 is threadedly secured within threaded opening 250 and serves to secure hub bottom 10 to hub top 20.

Figure 12:
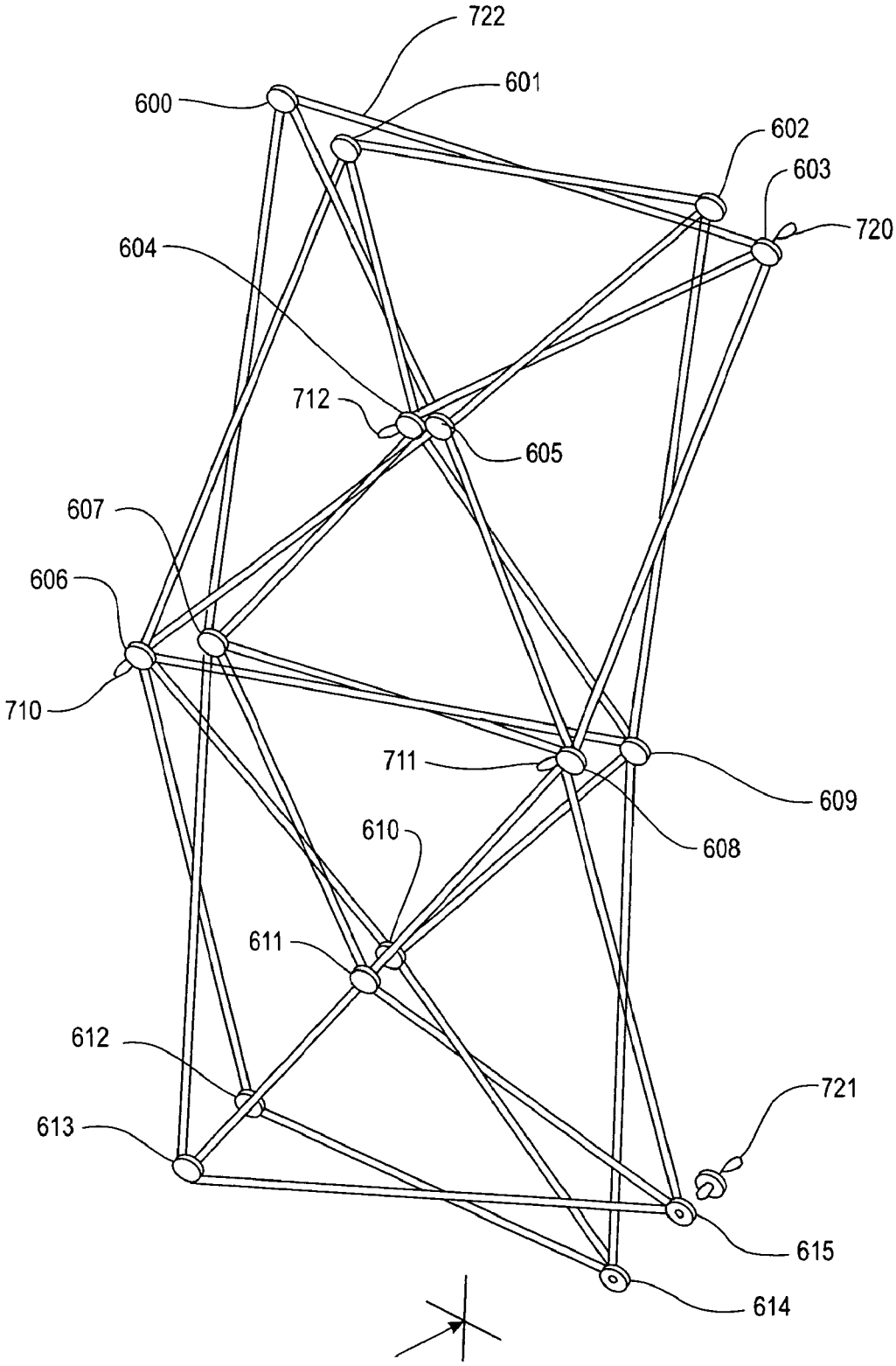
FIG. 12 is an oblique view of two sections ("quads") of a deployable structure showing the positions of the hub in place.

FIG. 12 depicts an isometric view of segments of a deployable shelter showing a plurality of articulating hub assemblies 600 to 615 connected to tubular struts 620 to 631 together forming the matrix upon which the fabric cover 700 (not shown) rests and to which it is secured. From the perspective of fabric 700 (not shown) which will cover the matrix, the assembly has both external loops 710 to 712 and internal loops 720 to 722.

Figure 13:
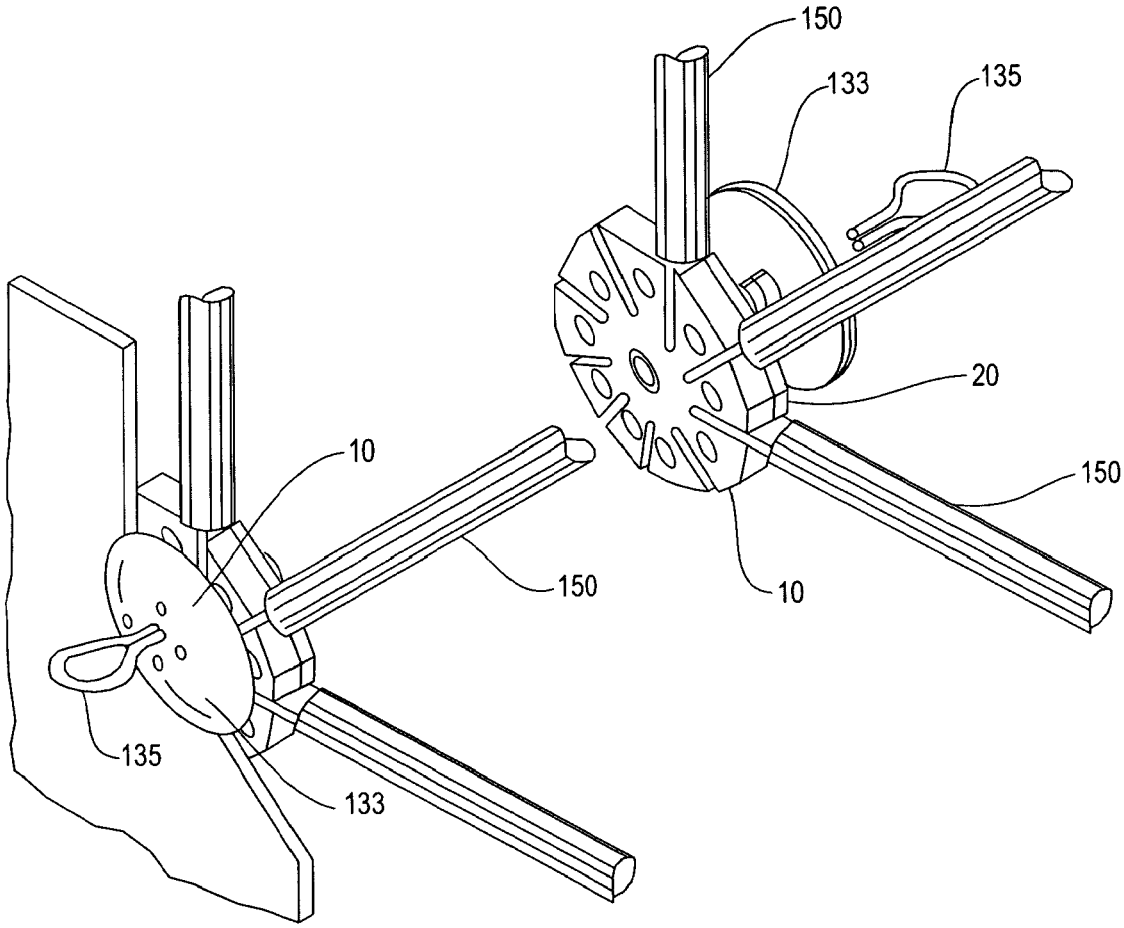
FIG. 13 is an oblique view of two hubs connected to tubular struts in place.

FIG. 13 is an exploded view of a portion of the matrix depicted in FIG. 12 showing the spatial relationship of the hubs 100 with inferior section 10 and superior section 20, tubular struts 150, fabric 600, keeper component 134 and loop 135.

Figure 14:
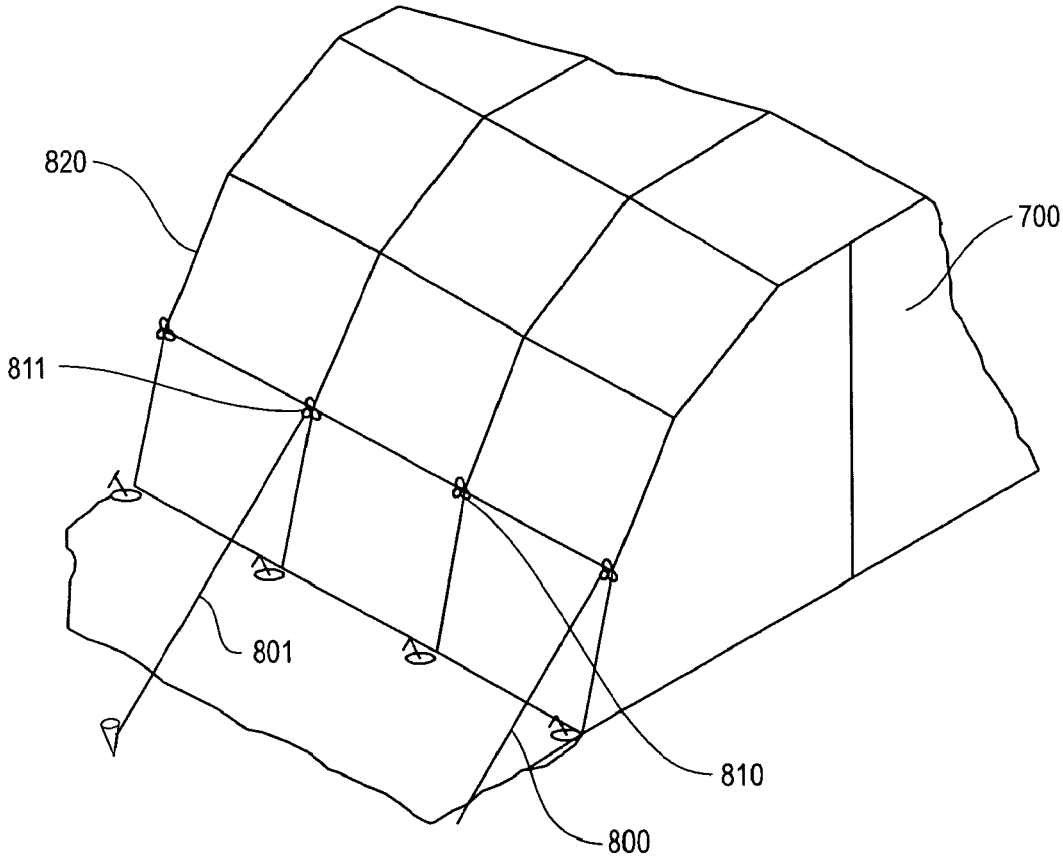
FIG. 14 depicts the deployable shelter erected and in place with the keepers secured to ground lines.

FIG. 14 is a schematic diagram of a portion of a typical deployable shelter showing securing lines 800 and 801 attached to external loops 810 and 811. FIG. 14 depicts a substantial portion of the deployment shelter covered with protective fabric 700 and the balance of the shelter uncovered with tubular struts 820 exposed. The benefit of the shelter directly resulting from the articulating hub assembly is the portability of same and ability to raise large structures from small transporting packages. For example, an assembled shelter covering 386 $ft^2$ can be carried to the site for striking in a parcel 5 ft×3 ft×2 ft.

All the components comprising the deployable shelter described hereinabove are interchangeable. The hub sections are joined together using screws making replacement a simple step. Also the tubes can be individually replaced without having to remove the entire collection of tubes before the individual tube in the collection is replaced such as is the case in the prior art.

Thus while there have been shown, described and pointed out fundamental features of the invention as applied to currently preferred embodiments thereof, it will be understood that various omissions and substitutions and changes in form and details of the method and apparatus illustrated, and in their operation, may be made by those skilled in the art without departing from the spirit of the invention. In addition it is to be understood that the drawings are not necessarily drawn to scale but that they are merely conceptual in nature. It is the intention, therefore, to be limited only by the scope of the claims appended herewith.

What I claim and desire to protect by Letters Patent is:

1. An articulating hub assembly suitable for use in collapsible structures comprising:

a hub body comprising rigid octagonally-shaped mating top and bottom components, said octagonal shape of said hub body defined by a periphery having eight straight edges at said periphery of said hub body and eight slits, each said slit extending radially inwardly from said periphery through said top and said bottom components from and normal to each said straight edges at said periphery of said hub body, each said slit is located at a vertex formed at intersections of each of said edges around said periphery of said hub body, and consistent with the octagonal configuration of said periphery of said hub body, adjacent slits emanating from each succeeding and preceding slit relative to said slit which is normal to said edge are aligned 45° with respect thereto; and said hub top-component defined by a periphery, having an exterior and an interior surface, a central boss receiving opening, a plurality of said radial slits extending through said hub top, and a plurality of openings disposed radially toward the periphery of said hub top component, said openings being arranged to provide a single opening positioned in each of the areas defined in-between two adjacent said slits and arranged to conform to the position of said openings through said hub bottom when the hub top and hub bottom are joined; and said hub bottom-component wherein each of said edges of said periphery is in alignment with said edges of said top component, having an exterior and an interior surface, a boss extending upwardly from said interior surface of said bottom component, a central opening within said boss and a plurality openings disposed radially toward the periphery of said component, said openings being arranged to provide a single opening positioned in each of the areas defined in-between two adjacent said slits and arranged to conform to the position of said openings through said hub top when said hub top and said hub bottom are joined; and each said slit in said hub bottom component having a discontinuous groove located perpendicular thereto and extending across said slit into each of said areas defined in-between two adjacent said slits;

said hub top component and said hub bottom component being assembled contiguously so that said central openings, said radial slits and said openings extending through said hub top component and said hub bottom component, and into said hub top component and said hub bottom component, are in registry; and a removable fastening means extending through said openings in said hub top component and being secured in said openings in registry therewith in said hub bottom component; and an integrally formed keeper element having a top and a shaft extending downwardly therefrom, wherein said shaft is capable of being inserted into and withdrawn from said central openings through said hub body and said hub cover, and said integrally formed keeper element, has means to secure said hub top component to said hub bottom component; and a plurality of tangs, each tang having a first side and a second side, a tail, and a head section with a roll pin extending from each side, said head section of said tang positioned in one of said radial slits in said hub bottom component and said hub top component in registry therewith, said tang being held in place by said roll pin nested in said discontinuous groove; and a cylindrical plug and a structural element secured to said tang.

2. The articulating hub assembly defined in claim 1 wherein said slits in said hub body are positioned such that each occupies a unique geometric plane.

3. The articulating hub assembly defined in claim 1 wherein said central opening is threaded.

4. The articulating hub assembly defined in claim 3 wherein said keeper shaft is threaded to coincide with the central threaded opening of said hub bottom to allow said shaft to be threadedly engaged therein.

5. The articulating hub assembly defined in claim 4 wherein said tang head has an opening therethrough, said head section of said tang fits in said slits in said hub top component and said hub bottom component is in registry therewith, said tang being held in place by a roll pin which is inserted through said opening of said tang head and which is nested in said discontinuous groove of said hub bottom component.

6. The articulating hub assembly defined in claim 5 wherein said structural element is a tubular structure having a predetermined inside diameter greater than ⅝" and said cylindrical plug having a first end and a second end, said first end having a crown thereon, said cylindrical plug having a slot extending longitudinally therethrough, said first end of said cylindrical plug being received in said tail section of said tang, said second end of said cylindrical plug having exterior dimensions coincident with the inside diameter of said structural element, said second end of said cylindrical plug being inserted into said structural element.

7. The articulating hub assembly defined in claim 6 wherein a rivet secures said tang tail section of said tang positioned in said plug to said tubular structure.

8. The articulating hub assembly defined in claim 6 wherein a cover is atop said tubular structure which is secured in place between said keeper and said hub body.

9. The articulating hub assembly defined in claim 5 wherein said head section of said tang is wider than said tail section and merges therewith at a shoulder.

10. The articulating hub assembly defined in claim 6 wherein said hub body is circular in shape.

11. The articulating hub assembly defined in claim 6 wherein said top of said keeper element is contoured to match a contoured slope of an exposed surface of said hub cover.

12. The articulating hub assembly defined in claim 6 wherein said keeper shaft is unthreaded and fits through said central openings of said hub top component and said hub bottom component, said keeper shaft having an end being divided into two elements which are splayed to be fixed to an underside of said hub body to fasten said hub top component to said hub bottom component.

13. The articulating hub assembly defined in claim 12 wherein said head section of said tang is joined directly perpendicular to a surface of said plug facing said hub cover and said hub body when installed.

14. The articulating hub assembly defined in claim 12 wherein said hub top and bottom are octagonal in shape.

15. The articulating hub assembly defined in claim 1 wherein said assembly is made of metal, thermoplastic or thermoset material.

16. The articulating hub assembly defined in claim 1 wherein a loop is secured to said top of said keeper.

17. The articulating hub assembly defined in claim 1 wherein said hub top component contains a plurality of wells.

18. The articulating hub assembly defined in claim 1 wherein said hub bottom component contains a plurality of wells.

19. The articulating hub assembly defined in claim 1 wherein an exterior end of radially disposed openings in said hub top component has a recess to accommodate a fastener.

20. The articulating hub assembly defined in claim 1 wherein the exterior end of each of said radially disposed openings in said hub bottom component has a recess to accommodate a fastener.

21. An articulating hub and strut assembly suitable for use in collapsible structures comprising:

a plurality of articulating hub assemblies, each said articulating hub assembly comprising a hub body comprising rigid octagonally-shaped mating top and bottom components, said octagonal shape of said hub body defined by a periphery having eight straight edges at said periphery of said hub body and eight slits, each said slit extending radially inwardly from said periphery through said top and said bottom components from and normal to each said straight edges at said periphery of said hub body, each said slit is located at a vertex formed at intersections of each of said edges around said periphery of said hub body, and consistent with the octagonal configuration of said periphery of said hub, adjacent slits emanating from each succeeding and preceding slit relative to said slit which is normal to said edge are aligned 45° with respect thereto; and said hub top-component defined by a periphery, having an exterior and an interior surface, a central boss receiving opening, a plurality of said radial slits extending through said hub top, and a plurality of openings disposed radially toward the periphery of said hub top component, said openings being arranged to provide a single opening positioned in each of the areas defined in-between two adjacent said slits and arranged to conform to the position of said openings through said hub bottom when the hub top and hub bottom are joined; and said hub bottom-component wherein each of said edges of said periphery is in alignment with said edges of said top component, having an exterior and an interior surface, a boss extending upwardly from said interior surface of said bottom component, a central opening within said boss and a plurality openings disposed radially toward the periphery of said component, said openings being arranged to provide a single opening positioned in each of the areas defined in-between two adjacent said slits and arranged to conform to the position of said openings through said hub top when said hub top and said hub bottom are joined; and each said slit in said hub bottom component having a discontinuous groove located perpendicular thereto and extending across said slit into each of said areas defined in-between two adjacent said slits;

said hub top component and said hub bottom component being assembled contiguously so that said central openings, said radial slits and said openings extending through said hub top component and said hub bottom component, and into said hub top component and said hub bottom component, are in registry; and a removable fastening means extending through said openings in said hub top component and being secured in said openings in registry therewith in said hub bottom component; and an integrally formed keeper element having a top and a shaft extending downwardly therefrom, wherein said shaft is capable of being inserted into and withdrawn from said central openings through said hub body and said hub cover, and said integrally formed keeper element, has means to secure said hub top component to said hub bottom component; and a plurality of tangs, each tang having a first side and a second side, a tail, and a head section with a roll pin extending from each side, said head section of said tang positioned in one of said radial slits in said hub bottom component and said hub top component in registry therewith, said tang being held in place by said roll pin nested in said discontinuous groove, said tail having an opening; and a plurality of plugs, each plug having a crown, a shoulder, a plurality of ribs, and a central opening slot, said tail of said tang secured within said central opening slot of said plug; and b) a plurality of struts, each said strut having a dimension coincident with the exterior dimension of a ribbed portion of said plug, said ribbed portion of said plugs secured within an end of said strut by a fastener that passes through both said plug and said tang tail by way of said opening in said tang tail.

22. The articulating hub-strut assembly defined in claim 21 wherein said struts, tangs and slits are positioned such that each strut and tang subassembly pivot within a unique geometric plane.

23. The articulating hub-strut assembly defined in claim 21 wherein said struts are comprised of metal, composite, thermoplastic or thermo set material.

24. The articulating hub-strut assembly defined in claim 21 wherein said struts are greater than four feet in length.

25. The articulating hub-strut assembly defined in claim 21 wherein said struts have a circumference greater than 1.8 inches.

26. A collapsible shelter comprising:

a) A plurality of articulating hub assemblies, each comprising a hub body comprising rigid polygonally-shaped mating top and bottom components, said polygon shape of said hub body defined by a plurality of straight edges at the periphery of said hub body and a plurality of slits extending inwardly through said top and bottom components from and normal to said straight edges at said periphery of said hub body, there being a slit located at the intersection of each of said edges at said periphery of said hub body, and consistent with the polygonal configuration of said periphery of said hub body, adjacent slits emanating from each succeeding and preceding slit relative to said slit which is normal to said edge are aligned with angle respect thereto; and said hub top component having a periphery, an exterior and interior surface, a central boss receiving opening, a plurality of said radial slits extending through said hub top, and a plurality of openings disposed radially toward the periphery of said component, said openings being arranged to provide a single opening positioned in each of the areas defined in-between two adjacent slits and arranged to conform to the position of said openings through said hub bottom when the hub top and hub bottom are joined; and said hub bottom component having and an exterior and interior surface and a central opening within a boss and a plurality of openings disposed radially toward the periphery of said component, said openings being arranged to provide a single opening positioned in each of the areas defined in-between two adjacent slits and arranged to conform to the position of said openings through said hub top when the hub top and hub bottom are joined; and each said slit in said hub bottom component having a discontinuous groove located perpendicular thereto; and said hub top and said hub bottom being assembled contiguously so that said central openings, said radial slits and said openings extending through said hub top and bottom and into said hub top and bottom are in registry; and a removable fastening means extending through said openings in said hub top and being secured in said openings in registry therewith in said hub bottom; and an integrally formed keeper element having a top and a shaft extending downwardly therefrom, wherein said shaft is capable of being inserted and withdrawn from said central openings through said hub body and said hub cover and when inserted in said central opening has means to secure said hub top to said hub bottom; and a plurality of tangs, each tang having a first side and second side, a tail, and a head section with a roll pin extending from each side, said head of said tang positioned in one of said radial slits in said hub bottom and said hub top in registry therewith, said tang being held in place by said roll pin nested in said discontinuous groove, said tail having an opening; and a plurality of plugs, each plug having a crown, a shoulder, a plurality of ribs, and a central opening slot, the tail of said tang secured within said central opening slot of said plug; and b) a plurality of struts, each strut having an interior dimension coincident with the exterior dimension of the ribbed portion of said plug, said ribbed portion of said plugs secured within the end of said strut by a fastener that passes through both said plug and said tang tail by way of said opening in said tang tail; and c) a cover passing over said hub assemblies and struts, said cover having openings through which pass the shaft of said keeper, the shaft of said keeper being reversibly secured to said hub bottom; and d) loops, said loops secured to said keepers;

said shelter being capable of being collapsed into a bundled form or erected into a three-dimensional form, wherein the movement of said struts during either erection or compaction of said shelter occurs in unique geometric planes.

27. The portable shelter described in claim 26 where an interior cover is secured to the interior surface of said shelter by means of keepers inserted through openings in said cover and secured in the central opening of said hub bottom.

28. The portable shelter described in claim 27 wherein said keepers are threadedly secured.

* * * * *